United States Patent [19]

Guillaume et al.

[11] 4,182,389

[45] Jan. 8, 1980

[54] SYSTEM FOR MOORING A SHIP TO A LOADING STRUCTURE AND FOR TRANSFERRING A FLUID, PARTICULARLY FOR PETROLEUM INSTALLATIONS

[75] Inventors: Daniel Guillaume, Rueil-Malmaison; Samuel Tuson, Mesnil-le-Roi, both of France

[73] Assignee: Entreprise d'Equipements Hydrauliqes E.M.H., France

[21] Appl. No.: 853,539

[22] Filed: Nov. 21, 1977

[30] Foreign Application Priority Data

Nov. 25, 1976 [FR] France ..... 76 35543

[51] Int. Cl.[2] ..... B65B 1/04

[52] U.S. Cl. ..... 141/387; 114/230; 9/8 P; 137/344; 137/799

[58] Field of Search ..... 137/799, 344; 114/230; 141/382, 387, 388, 279; 244/135 A; 9/8 P, 3

[56] References Cited

U.S. PATENT DOCUMENTS

| | | | |
|---|---|---|---|
| 1,685,927 | 10/1928 | Miller | 137/344 X |
| 3,100,006 | 8/1963 | Sheets | 141/388 X |
| 3,315,630 | 4/1967 | Hopkins | 114/230 |
| 3,773,093 | 11/1973 | Eustace | 141/388 |
| 3,863,590 | 2/1975 | Karl | 114/230 |
| 3,918,386 | 11/1975 | McClain | 114/230 |
| 3,978,810 | 9/1976 | Lucht | 9/8 P |
| 3,980,037 | 9/1976 | Tuson | 114/230 |
| 3,992,934 | 11/1976 | Clark | 114/230 X |
| 4,023,517 | 5/1977 | Ryan | 114/230 |

*Primary Examiner*—Harold W. Weakley
*Attorney, Agent, or Firm*—Steinberg & Blake

[57] ABSTRACT

A system for mooring a ship or like floating vessel to an offshore structure and for transferring a fluid between duct means provided on said ship and structure, respectively, comprising at least one hawser and at least one fluid transferring hose pipe connected with one end thereof to duct means on one of the ship and the structure and with its opposite free end to one end of said hawser, wherein the improvement consists in that said hose pipe end is provided with connecting means which, in the stowage position, is normally connected to one of the ship and the structure, said means being adapted to be detached from said one of the ship and the structure, in order to be attached to the other one of said ship and structure whereas a tow-line is provided for at the same time drawings along the hawser towards its operative position, said hose pipe end being provided with pipe fittings for removable connection to duct means on the other one of said ship and structure.

9 Claims, 7 Drawing Figures

SYSTEM FOR MOORING A SHIP TO A LOADING STRUCTURE AND FOR TRANSFERRING A FLUID, PARTICULARLY FOR PETROLEUM INSTALLATIONS

The present invention relates to systems for mooring a ship or like floating vessel, notably a petroleum transport vessel or tanker, to a loading (or storage) structure, particularly an offshore tower or column, and also for ensuring the transfer of a fluid such as petroleum.

Its purpose is mainly to simplify as much as possible the mooring of the ship and the putting in place of the transfer device, and also to ensure greater safety.

It is already known, in systems for mooring a tanker to a tower, comprising a mooring hawser in combination with a hose or flexible pipe (carried either by the structure or the ship) which, in the mooring position, is intended to allow the transfer of the fluid, to connect the end of the said pipe to an end of the hawser, so as to perform in a single operation the putting in place of these two members during the mooring.

In such prior-art systems, however, the common end of the hawser and the pipe, after reaching the structure or the ship (as the case may be), had to be separated in order to ensure independently, on the one hand, the fixing of the hawser and, on the other hand, the fixing of the end of the pipe on the conduit to be connected. Moreover, the relative motions of the ship with respect to the structure under the action of sea heave were not sufficiently taken into account, thus resulting in often inadmissible strains, particularly on the flexible pipe.

In order to remedy these drawbacks, the system of the kind in question is so designed, according to the invention, as to allow for the connection, on a common bar, on the one hand, of one end of the hawser and/or of at least one cable co-operating with the latter for the mooring operation, and, on the other hand, a connecting element carried, preferably pivotally, by the free end of the flexible pipe, the said bar being adapted to be attached either on the structure (or the ship) or on hooks provided on the ship (or the structure), and the said element being provided with removable means for pivotally connecting it to the conduits to be connected (provided on either the ship or the structure, depending upon the contemplated application).

The double mooring and transfer operation can thus be carried out very rapidly.

Moreover, owing to the pivotal connections provided, the element for connecting the flexible pipe may take any orientation, so that the effects of heave are not to be feared.

According to a preferred arrangement, the above-mentioned connecting element is U-shaped and its base is pivotally connected to the flexible pipe whereas its ends are provided with flanges aligned along the direction of the carrying axis-bar and are intended to ensure the connection with the conduit to be connected, using rotary joints mounted along the axis of the said bar, so as to allow the said U-shaped element to take any orientation around the said bar.

As for the attachment of the said axis bar, it is performed notably in the mooring and transfer position on two hooks provided on the installation to be connected and arranged on either side of the central portion of the axis bar on which will be attached the hawser and the cable or cables co-operating therewith, notably the hawser and a towing cable or tow-line intended to move the hawser to the mooring position.

The said hooks are preferably of a known quick-release type.

Advantageously, means are provided to allow the tractive force exerted on the hawser to be measured at each instant, in combination with means for automatically releasing the assembly, when the said force exceeds the resisting capacity of the hawser.

Apart from the above arrangements, the invention comprises certain other arrangements which are used preferably at the same time and which will be referred to more explicitly hereinafter.

It is more particularly directed to certain forms of application, as well as certain forms of embodiment, of the said arrangements; and it is still more particularly directed, as novel industrial products, to the systems of the kind in question, involving application of these same arrangements, as well as the special elements appropriate to their mounting, and the assemblies or installations, notably the off-shore towers of platforms and the tankers, for the transfer of petroleum or gas.

And it will, in any case, be well understood by means of the following description complement, as well as the appended drawings, which complement and drawings are of course given mainly as an indication.

FIG. 1, in these drawings, is a diagrammatic elevational view of an off-shore tower with a connecting flexible pipe and of a tanker to which it is required to connect, by means of the system according to the invention, the end of the said pipe, and to perform at the same time the mooring.

Figure 7:
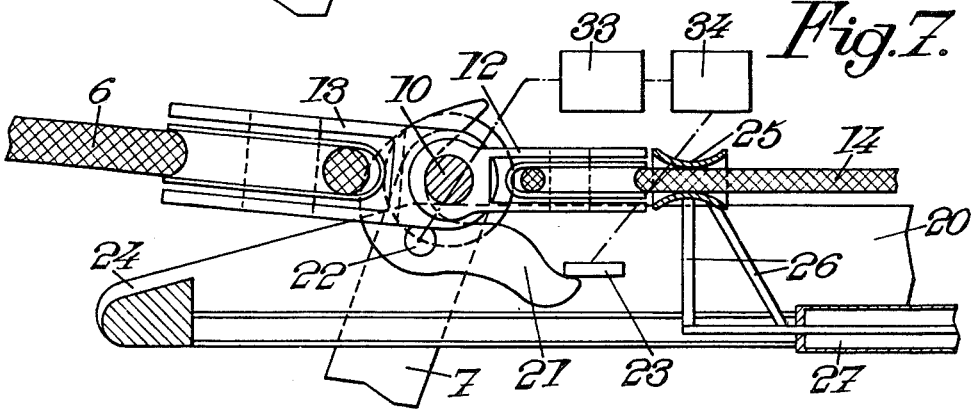

Lastly, FIG. 7 similarly illustrates the final mooring and transfer position.

According to the invention, and according more specially to those of its forms of application, and also to those of the forms of embodiment, of its various parts, to which it seems appropriate to give preference, considering for example an off-shore tower or column 1, notably pivotally secured at its base, and provided with floats 2 to ensure its buoyancy, the said tower being provided with an arm 3 carrying at its free end a connecting hose or flexible pipe 4, which pipe, mounted at the end of a conduit (not shown) running in the tower, is apt to ensure the connection between this conduit and the one carrier by a tanker 5, the transfer of the fluid between the tower and the tanker, at the same time as the mooring, is performed as follows, or in a similar manner.

Before describing the invention, it is essential to note that the application which is contemplated in the drawings is contemplated only for the needs of the explanation, which would remain appropriate to any other general arrangement, for example for a hose or flexible pipe carried by the ship and apt to be connected to the conduits of the tower or of any other structure, the point always being to obtain both a mooring or a mechanical securing and a transfer of fluid.

Figure 1:
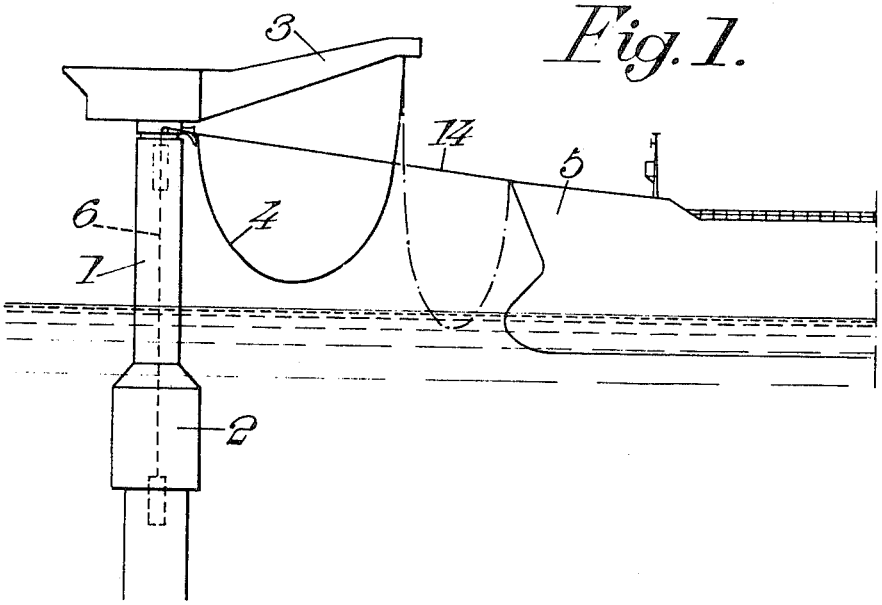

Reverting therefore by way of example to the case referred to in the drawings, the transfer and mooring system is arranged in such a manner that from the position of rest represented in full lines in FIG. 1, in which the flexible pipe 4 is attached by its free end to the platform, the said pipe can be moved to the tanker (dash-dotted line) with the hawser and the attached assembly and be placed in a condition of transfer on the conduit of the said tanker, without requiring the corresponding ends of the hawser and the pipe to be dealt with separately on the said tanker.

It is also assumed, in FIG. 1, that the hawser 6 (FIG. 1) in the position of rest is retracted within the tower, but any other arrangement can be adopted, notably one in which the said hawser either unrolls from a drum or remains outside the said column.

Figure 2:
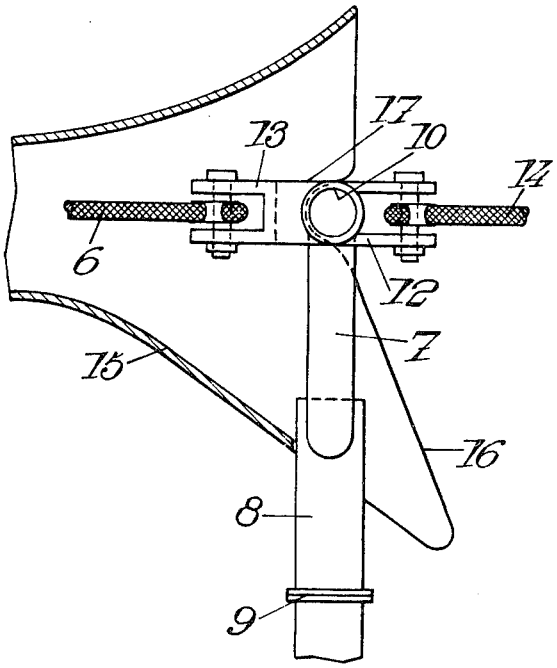
FIGS. 2 to 4 show, to a larger scale, the essential elements of the said system, in vertical section, side view and top sectional view, respectively, in the position of rest on the platform.
Figure 3:
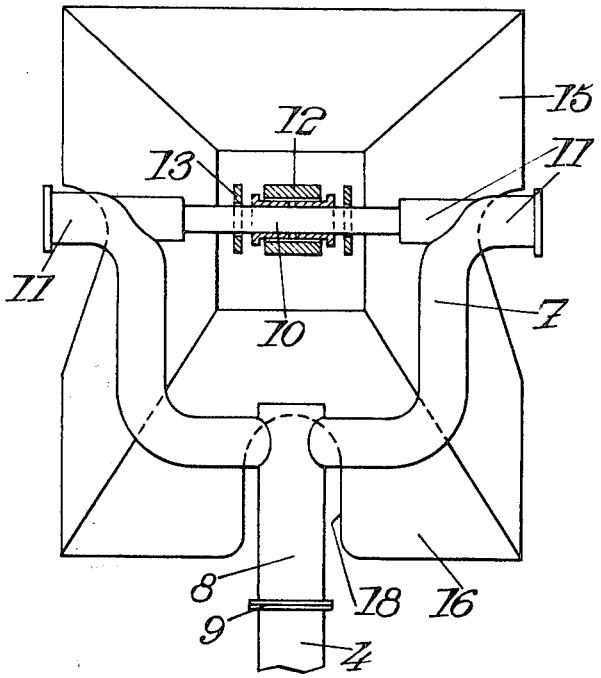
Figure 4:
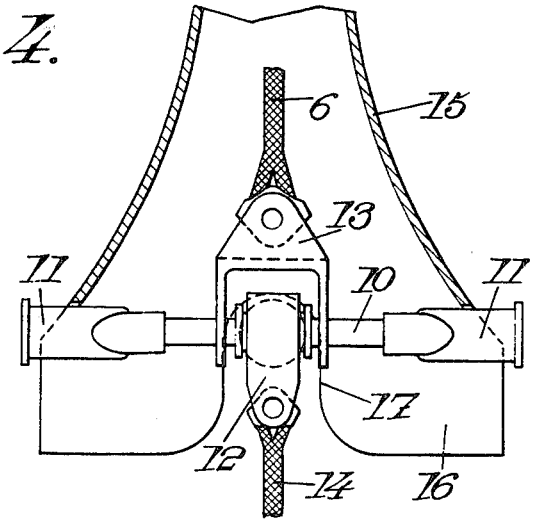

To the end, use is made of a U-shaped or like connector element 7 (FIGS. 2 and foll.), the base of which is pivotally connected through the medium of a pipe fitting 8 and a rotary joint 9 to the pipe 4, so as to allow it to rotate freely during the relative motions of the pipe 4, the said U-shaped element being on the other hand connected, at the ends of its arms, to a bar end of suitable strength, e.g. tubular, through the medium of bent connecting elements 11 which will serve to ensure the transfer as will appear later. On the central portion of the bar 10 comprised between the two connecting elements 11 are provided (FIG. 2 to 4) clevis, yoke or flange devices 12, 13 allowing the ends of the cables used during the mooring and transfer operation to be attached thereto.

There is thus provided a central clevis or flange 12 on which, in the example illustrated, a tow-line 14 can be attached, and a clevis 13 straddling the clevis 12 and on which the corresponding end of the hawser 6 assumed in the example illustrated to be initially retracted within the tower can be attached.

Means are provided to facilitate the engagement and retention of the system in position of rest on the tower, the said means comprising for example a kind of stationary trumpet 15 with an inclined surface 16 to guide the axis bar 10 towards the recess 17 adapted to receive the same. Another recess 18 is provided in the lower portion of the trumpet to allow free passage of the pipe fitting 8.

Figure 5:
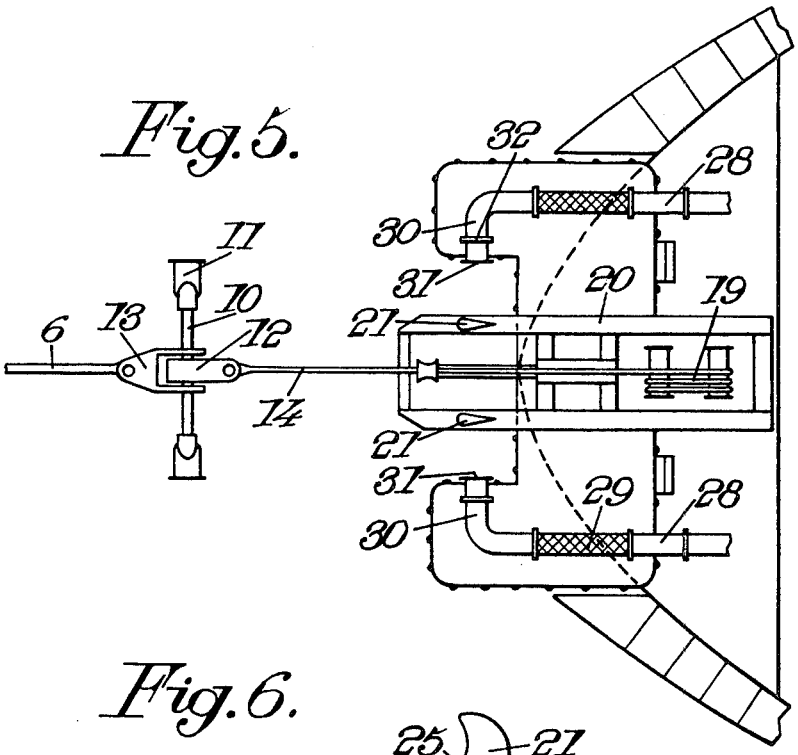
FIG. 5 is a partial top view of the tanker and of the said system in the position in which, being drawn by the tow-line, it is moved towards the head of the ship.

It is already seen that, having such a system available, it can be easily moved towards the tanker by means of the tow-line 14, which is supposed to be winding onto a winch 19 (FIG. 5) provided on the said tanker, and the free end of which is attached to the clevis or stirrup 12 at the time of mooring, by any appropriate means.

Considering now the installation to be provided on the tanker (in the assumed example) to receive the system described above, the said installation comprises essentially:

on the one hand, a frame 20 secured at the bow of the tanker and provided with mooring hooks or the like 21, preferably of an easily releasable type and adapted to receive the axis bar 10, and conduit connection fittings provided with means for allowing, after the mooring, a certain freedom of rotation of the above-mentioned U-shaped connecting element 7.

Figure 6:
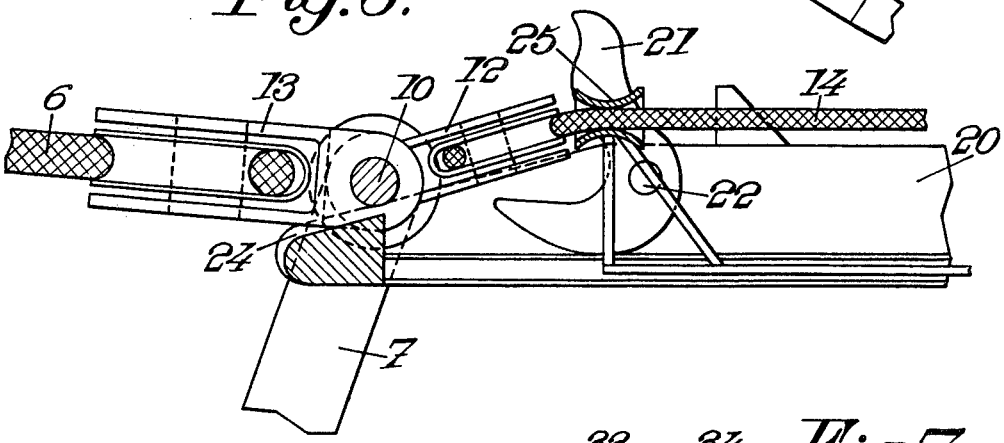
FIG. 6 is a cross-sectional view of the axis bar of the said system, in a position where the latter is being guided towards the mooring position.

FIGS. 6 and 7 diagrammatically illustrate a form of embodiment wherein two hooks 21 are mounted swingingly about axis pins 22 on the frame 1 and combined with locking means of a known type diagrammatized at 23. FIG. 6 shows the hooks in released position at the instant the hooking is about to take place. FIG. 7 shows the hooks in mooring and locking position, wherein both hooks have seized the axis bar 10 on either side of the stirrup assembly 12, 13, located at the center.

It is desirable to provide means for guiding the assembly constituted by the axis bar 10 and the element supported thereby as the said assembly moves nearer to the receiver system 20 under the tractive action exerted through the tow-line from the winch 19.

Such means are advantageously provided by combining an inclined access surface or ramp 24 located at the front of the said system 20 with a device for guiding the two-line and keeping it at a suitable height above the said system.

This device is constituted for example by a trumpet-shaped or like element 25 traversed by the two-line and supported at a suitable height by a support 26 which is preferably movable by means such as for example an actuator 27, for moving it either to a forward position appropriate to the mooring operation (FIG. 6) or to a retracted position (FIG. 7) allowing free passage of the axis 10 towards the mooring hooks 21.

As for the circuit of fluid to be provided on the ship and intended to be connected to the above-mentioned U-shaped device, it leads for example to two stationary pipes 28 connected through flexible pipes 29 to bends 30 against which, in the mooring position, the two pipe fittings 11 can be secured, the ends of the bends 30 being therefore so arranged as to be located in the mooring position oppposite the axis bar 10.

The connection of the U-shaped element is performed by means of connecting flanges 31 adapted to be secured on the corresponding flanges of the bend elements 11, preferably in an easily removable way. Furthermore, the ends of the bends 30 provided with the flanges 31 are equipped with rotary joints 32.

The whole assembly may also be completed with means, which, in case the hawser 6 in the mooring position is subjected to excessive tractive forces, allow the assembly to be automatically released, i.e. the hooks 21 and at the same time the removable connections to the flanges 31 to be released.

The escape of the fluid remaining in the conduits may be stopped by non-return means of any appropriate known type.

To ensure this automatic release, it will be sufficient to measure the tractive effort exerted on the hawser and to actuate the locking devices such as 23 (FIG. 7).

Advantageously, in order to measure the tractive effort, the case illustrated where the axis pins 22 in the mooring position are subjected, under the action of the traction, to a bending effort, the latter effort will be measured on at least one of axis pins 22 by any known method, for example those described in U.S. Pat. No. 3,648,514 of Mar. 14, 1972.

In FIG. 7 is shown quite diagrammatically an effort measuring device 33 connected to at least one of the axis pins 22 and itself connected to a control device 34 acting upon the system of locks 23, which system can be easily developed by any person skilled in the art.

Consequently, whatever the form of embodiment adopted, the mooring and transfer operations can be carried out under particularly simple conditions, the said operations being performed for example in the following manner.

The tanker being moved to a location in proximity to the tower 1, the tow-line is paid off in order to be attached to the stirrup 12 of the axis bar 10 which is then in the retracted position at the top of the tower, with the corresponding end of the flexible pipe 4.

Once this connection is completed, the tow-line is pulled by means of the winch 19 so as to extract the hawser 6 from the tower and at the same drag along the end of the flexible pipe 4 until the U-system according to the invention reaches the location of the frame 20, and so the axis bar 10, moving up the inclined surface 24 owing to the trumpet-shaped element 25 positioned by the actuator, causes the hooks 21 (FIGS. 6 and 7) to swing and thus effect the mooring, the hooks 21 being then fixed by a lock 23. During this operation the actuator 27 moves the trumpet element 25 rearward.

Immediately after, the bends 30 and 11 are assembled together by means of the removable flanges 31.

Thus the assembly is in both the mooring position and the transfer position, stop means being of course provided on the tower to retain the end of the hawser 6.

It will be noted that in this position the U-shaped member 7 is free to rotate about the direction of the axis bar 10 owing to the rotary joints 32.

As a result, and despite the heaving motion, the end of the flexible pipe 4 leading to the U-shaped device can take any orientation without additional strain being exerted on the said pipe.

It is thus seen that the invention offers many advantages over the already existing systems of the kind in question, particularly:

that of considerably simplifying the operations, and that of avoiding any useless strain on the flexible pipe either in the position of rest (FIG. 1) or in the mooring position (FIG. 7).

Of course the invention is by no mean limited to the forms of embodiment described and illustrated which have been given by way of example only. In particular it comprises all the means constituting technical equivalents to the means described as well as their combinations, should the latter be carried out according to its gist and used within the scope of the following claims.

What is claimed is:

1. A system for mooring a ship or like floating vessel to an off-shore structure and for transferring a fluid between duct means provided on said ship and on said structure, respectively, comprising: at least one hawser connected at one of its ends to said structure and having a free end and at least one fluid transferring hose pipe connected at one end to said duct means provided on said structure and provided at its other free end with connecting means adapted for being coupled to said duct means on said ship, and a tow-line having one end adapted to be picked up by the ship and a free end, the free end of said hawser and the free end of said tow-line being connected to said connecting means, said connecting means being retained at said structure in a stowage position, said connecting means being a U-shaped unit, the base of which being pivotally fluidly connected to said free end of said hose pipe whereas the legs of said U-shaped unit are interconnected by a bar member and provided with flanges aligned along the direction of said bar member to open outwardly, said flanges being adapted for connection with said duct means provided on said ship through rotary joints mounted in registering relationship with the axis of said bar member, so that the said U-shaped unit is rotatable about said axis, said bar member being fitted in particular on its central portion, with at least two clevises connectable to said free ends of said hawser and tow-line, respectively.

2. A system according to claim 1 wherein coupling means are provided for removably connecting said unit with said duct means provided on said ship, said coupling means being so arranged that, in the mooring and connecting position, the flanges of said U-shaped unit are opposite to corresponding flanges of said duct means.

3. A system according to claim 2, wherein said coupling means consist of two hooks for gripping the end portions of said bar member, respectively, which are carried by a frame equipped with a winch for winding up and paying out said tow-line.

4. A system according to claim 3, wherein guiding means are provided to allow the assembly constituted by said U-shaped unit together with said tow-line and said hawser attached to the latter, to be properly positioned at said coupling means, said guiding means comprising an inclined access ramp and a trumpet-shaped sleeve element through which said tow-line extends and which is movable to a suitable height with respect to the said access ramp at the time the mooring and connecting operation is performed.

5. A system according to claim 4, wherein said trumpet-shaped sleeve element is movable by an actuator so as to be retracted upon engagement of said bar member with said hooks.

6. A system according to claim 3, wherein said hooks are mounted pivotally and combined with a locking device for being selectively releasable.

7. A system according to claim 3, comprising releasing adapted means once the mooring is completed, to enable said hawser to be released automatically in case the tractive effort applied thereto exceeds a predetermined value, said releasing means including means for measuring the tractive effort, which are adapted to act upon operating means, for releasing said hooks.

8. A system according to claim 7, wherein said hooks are mounted for swinging motions about pivot pins, respectively and said measuring means are adapted to measure the bending effort to which at least one of said pins is subjected under the tractive effort of said hawser.

9. A system according to claim 1, wherein said off-shore structure is a tower with an arm carrying said hose pipe at the end of said arm, said ship being adapted to be moored to said tower.

* * * * *

UNITED STATES PATENT AND TRADEMARK OFFICE

CERTIFICATE OF CORRECTION

PATENT NO. : 4,182,389

DATED : January 8, 1980

INVENTOR(S) : Daniel Guillaume and Samuel Tuson

It is certified that error appears in the above-identified patent and that said Letters Patent are hereby corrected as shown below:

[73] Assignee:

ENTREPRISE D'EQUIPEMENTS MECANIQUES ET HYDRAULIQUES E.M.H.

Signed and Sealed this

*Fifth* Day of *August 1980*

[SEAL]

*Attest:*

SIDNEY A. DIAMOND

*Attesting Officer*

*Commissioner of Patents and Trademarks*